US005820403A

United States Patent [19]

Cheng et al.

[11] Patent Number: 5,820,403

[45] Date of Patent: Oct. 13, 1998

[54] TERMINATOR

[75] Inventors: Lee-Ming Cheng, Cupertino, Calif.; George Lee, Taipei, Taiwan; Joseph C. Tang, San Jose, Calif.; Jerry Wu, Chang-Hua Hsien, Taiwan

[73] Assignee: Hon Hai Precision Ind. Co., Ltd., Taipei Hsien, Taiwan

[21] Appl. No.: 629,522

[22] Filed: Apr. 9, 1996

[51] Int. Cl.[6] ..... H01R 4/24

[52] U.S. Cl. ..... 439/404; 439/405; 439/493; 439/637

[58] Field of Search ..... 439/135, 404, 439/405, 493, 634, 637

[56] References Cited

U.S. PATENT DOCUMENTS

| | | | |
|---|---|---|---|
| 4,295,704 | 10/1981 | Narzony et al. | 439/404 |
| 4,475,786 | 10/1984 | Root et al. | 439/404 |
| 4,538,873 | 9/1985 | Worth | 439/404 |
| 4,668,039 | 5/1987 | Marzili | 439/404 |
| 4,907,975 | 3/1990 | Dranchak et al. | 439/67 |
| 4,932,873 | 6/1990 | La Shier | 439/77 |
| 5,125,850 | 6/1992 | Locati | 439/404 |
| 5,199,899 | 4/1993 | Ittah | 439/404 |
| 5,498,172 | 3/1996 | Noda | 439/404 |

*Primary Examiner*—J. J. Swann

[57] ABSTRACT

An IDC type terminator (10) includes a housing (12) having a plurality of passageways (18) extending therethrough in the vertical direction. A plurality of contacts (20) are respectively received within the corresponding passageways (18). The upper and lower portions of the contacts (20) respectively and oppositely extending out of the housing (12) wherein the upper portions engage the PC board (15) which vertically stands on the housing (12), and the lower portions engage the corresponding flat cable (34) which is sandwiched between a bottom cover (16) and the housing (12). Opposite to the bottom cover (16), a top cover (14) is attached to the housing (12) for shielding the PC board (15) therein. A pair of cavities (22) are positioned on two opposite ends of the housing (12) so that the latches (58, 64) of the top cover (12) and of the bottom cover (14) may commonly but oppositely side by side occupy the corresponding cavity (22). Therefore, the latch (58) of the bottom cover (16) can be hooked against the inner shoulder (52) of the housing (12), and the latch (64) of the top cover (14) can be hooked against the bottom surface (42) of the housing (12) wherein once the top cover (14) and the bottom cover (16) have been completely and actually reach their fixed positions regard to the housing (12), the latches (58, 64) of the top cover (14) and of the bottom cover (16) can not be released from their locking positions so that the housing (12), the top cover (14) and the bottom cover (16) are reliably assembled together as one piece without risk of dissembling.

5 Claims, 11 Drawing Sheets

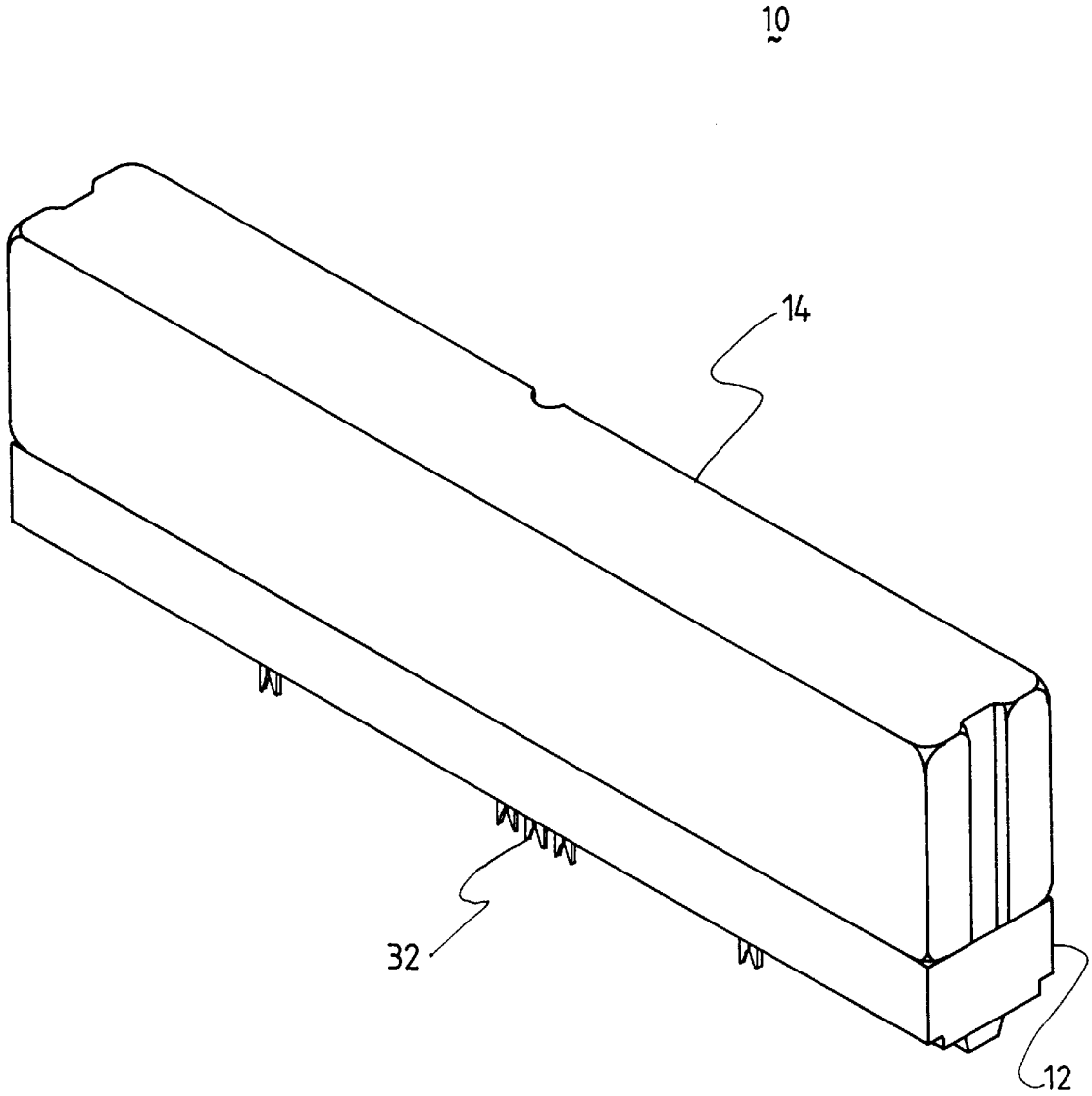
FIG, 2

FIG, 4

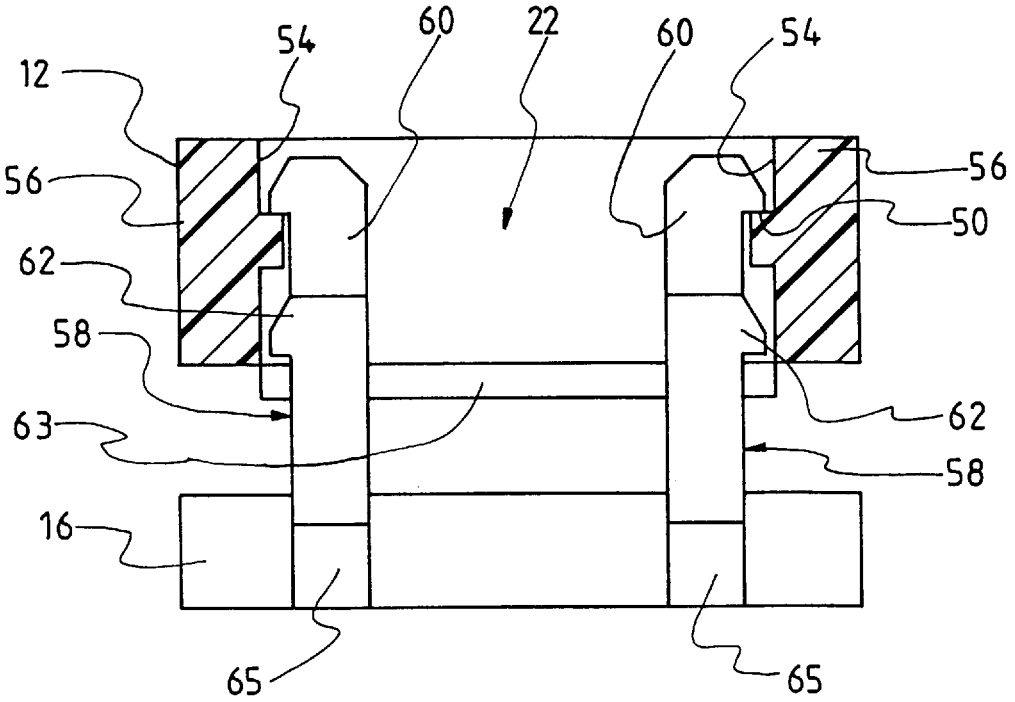
FIG,7
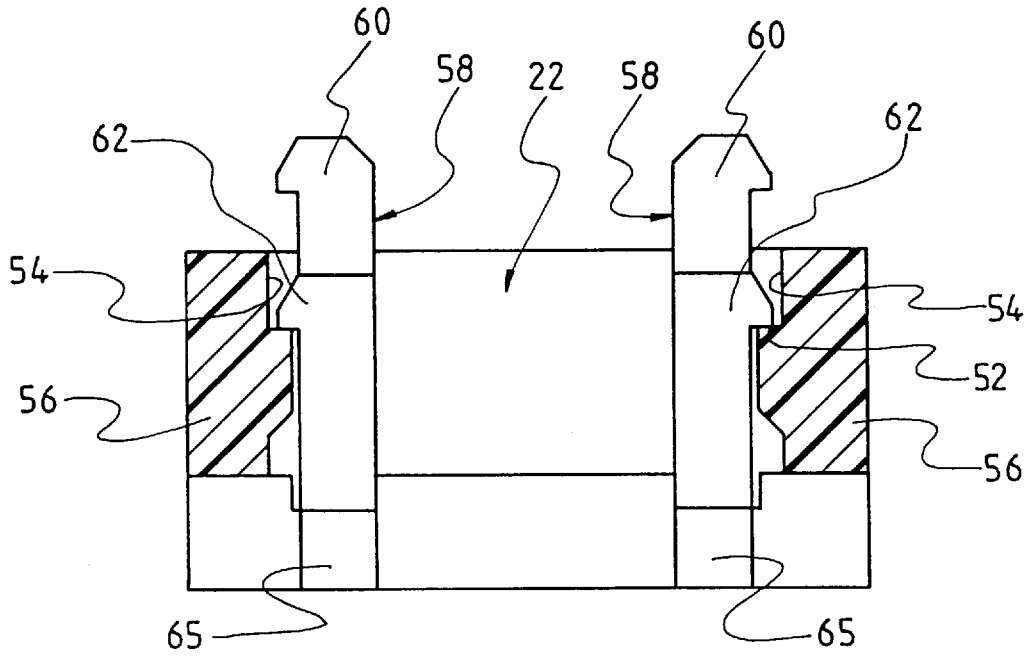
FIG,8

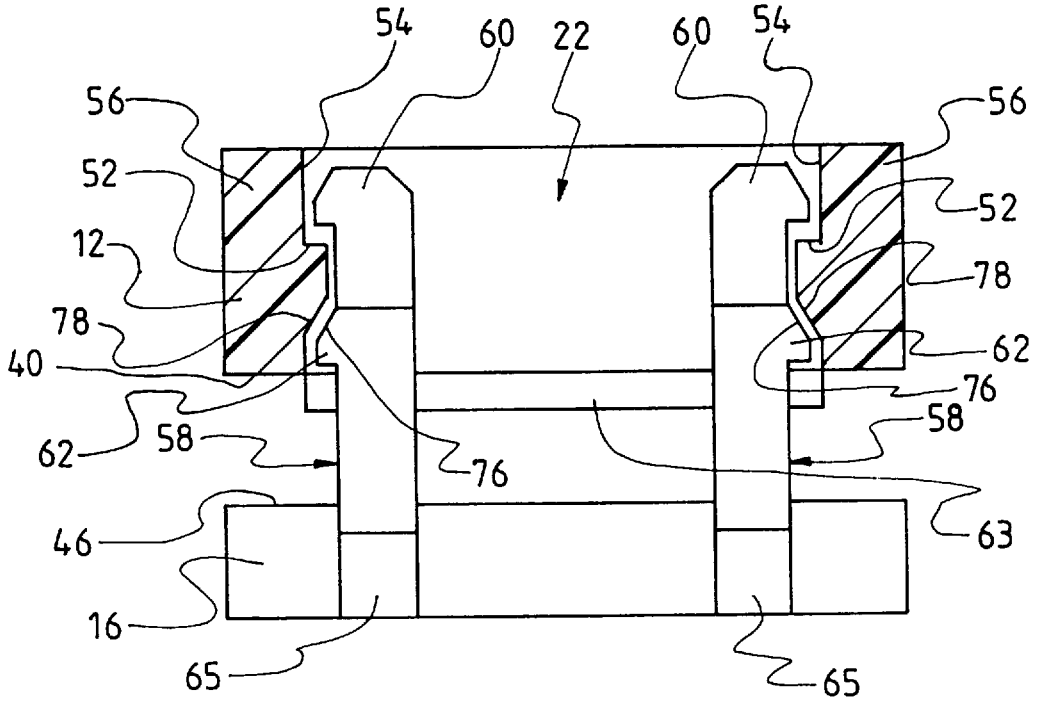
FIG, 7(A)

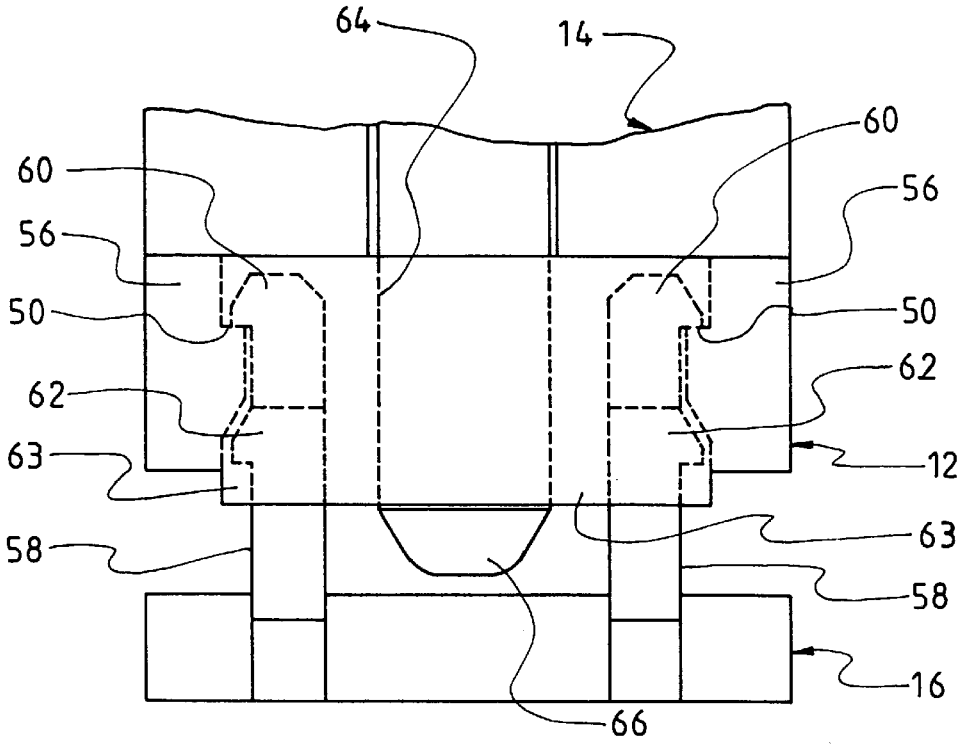
FIG, 9
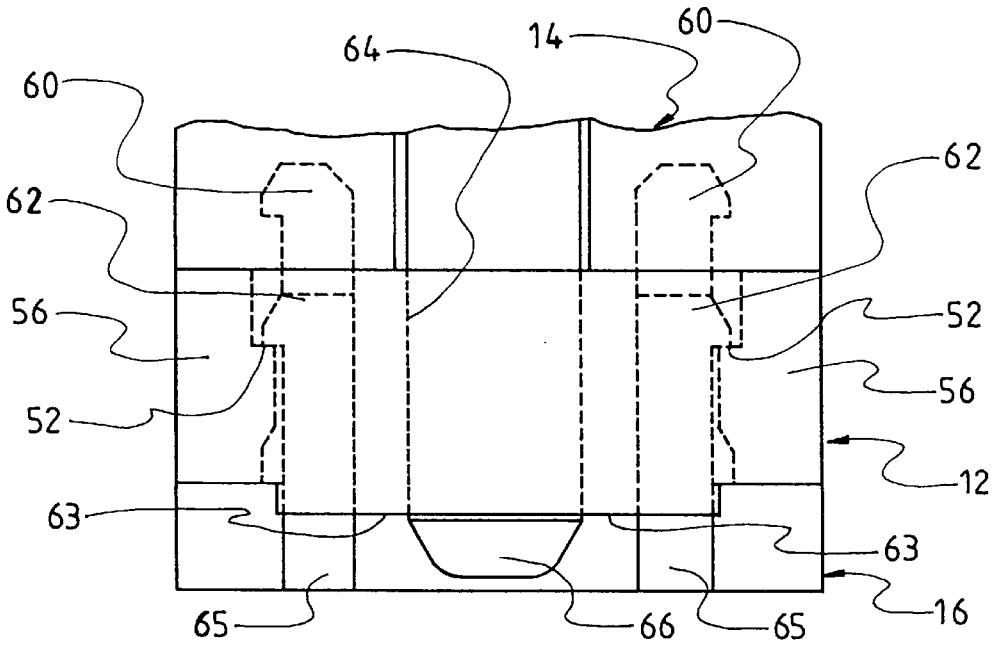
FIG, 10

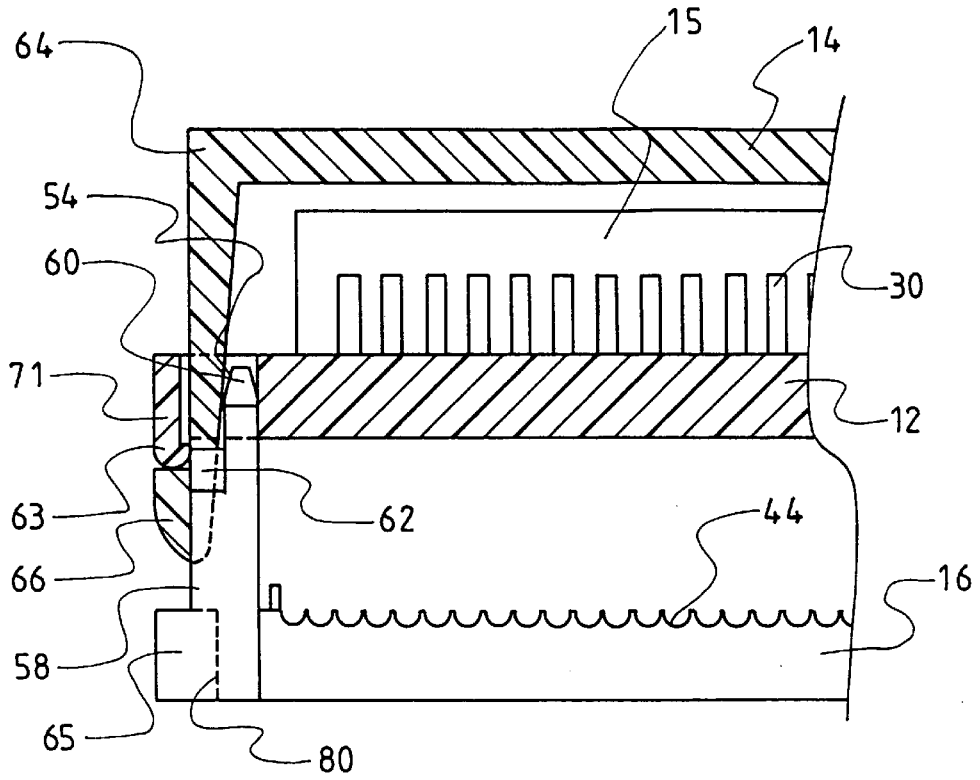
FIG,11
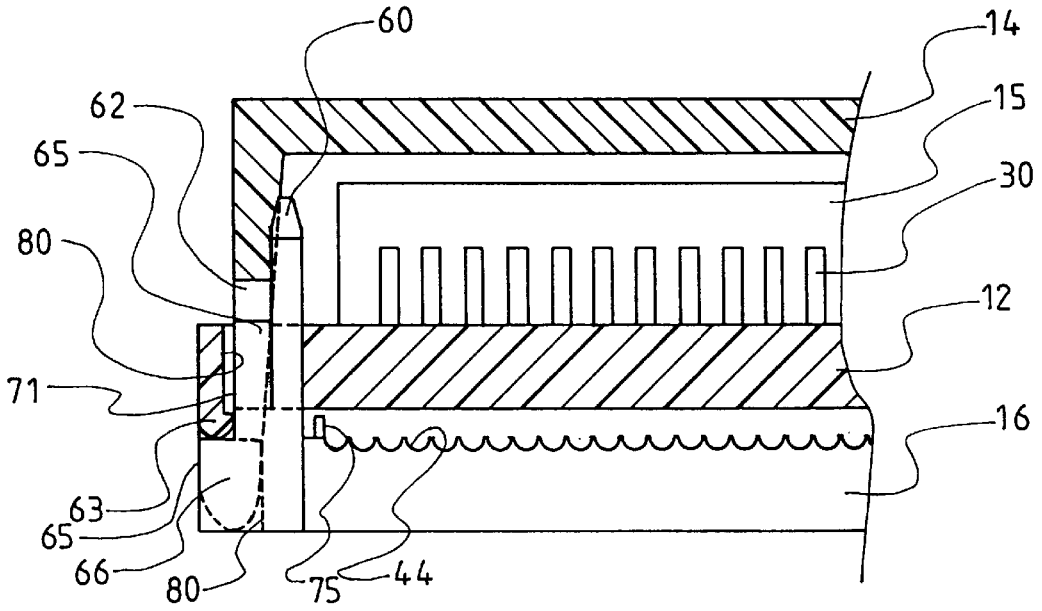
FIG, 12

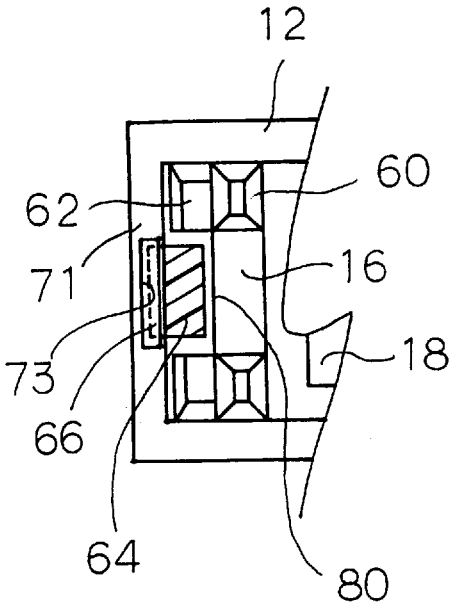
FIG, 13

TERMINATOR

BACKGROUND OF THE INVENTION

1. Field of The Invention

The invention relates to the terminator for use with a flat cable via its IDC (Insulative Displacement Contact) mechanism.

2. The Prior Art

Terminators are used on the mother board in the computer for forming a circuit loop. Some terminators, which is used independently, are themselves used with the counterpart connectors which is mounted on the mother board, on the Input/output port, or on the flat cable, for example, U.S. Pat. Nos. 4,857,002, 4,932,873, 5,108,294 and 5,472,348.

An object of the invention is to provide an IDC type terminator which is easy to be assembled and the whole terminator is reliably secured to the flat cable without possibility of detachment from such flat cable or disassembling itself.

SUMMARY OF THE INVENTION

According to an aspect of the invention, an IDC type terminator includes a housing having a plurality of passageways extending therethrough in the vertical direction. A plurality of contacts are respectively received within the corresponding passageways. The upper and lower portions of the contacts respectively and oppositely extending out of the housing wherein the upper portions engage the PC board which vertically stands on the housing, and the lower portions engage the corresponding flat cable which is sandwiched between a bottom cover and the housing. Opposite to the bottom cover, a top cover is attached to the housing for shielding the PC board therein. A pair of cavities are positioned on two opposite ends of the housing so that the latches of the top cover and of the bottom cover may commonly but oppositely side by side occupy the corresponding cavity. Therefore, the latch of the bottom cover can be hooked against the inner shoulder of the housing, and the latch of the top cover can be hooked against the bottom surface of the housing wherein once the top cover and the bottom cover have been completely and actually reach their fixed positions regard to the housing, the latches of the top cover and of the bottom cover can not be released from their locking positions so that the housing, the top cover and the bottom cover are reliably assembled together as one piece without risk of dissembling.

BRIEF DESCRIPTION OF THE DRAWINGS

FIG. 2 is a perspective view of the assembled housing and top cover of FIG. 1.

FIG. 7 is a side view of the assembled housing and bottom cover of FIG. 1 without the top cover thereon and contacts therein wherein the housing is cut away to be depicted by a cross-sectional view along line 7—7, to show the latchable engagement therebetween when the bottom cover is in a preliminary position.

FIG. 7(A) is a side view of the assembled housing and bottom cover of FIG. 1 without the top cover thereon and contacts therein wherein the housing is cut away to be depicted by a cross-sectional view along line 8—8, to show the latchable engagement therebetween when the bottom cover is in a preliminary position.

FIG. 8 is a side view of the assembled housing and the bottom cover of FIG. 7(A) without the top cover thereon and contacts therein to show the latchable engagement therebetween when the bottom cover is in a final position.

FIG. 9 is a side view of view of the assembled housing, bottom cover and top cover of FIG. 1 without contacts therein to show the mutual latching relationship among the housing, the bottom cover and the top cover wherein the bottom cover is in a preliminary position.

FIG. 10 is a side view of the assembled housing, bottom cover and top cover without contacts therein to show the mutual latching relationship among the housing, the bottom cover and the top cover wherein the bottom cover is in a final position.

FIG. 11 is a partially cross-sectional view, from a front viewpoint, of the assembled housing, bottom cover and top cover of FIG. 1 without contacts therein wherein the bottom cover is depicted by the elevation view to show the mutual latch relationship among the housing, the bottom cover and the top cover wherein the bottom cover is in a preliminary position.

FIG. 12 is a partially cross-sectional view, from a front viewpoint, of the assembled housing, bottom cover and top cover of FIG. 1 without contacts therein wherein the bottom cover is depicted by the elevation view to show the mutual latch relationship among the housing, the bottom cover and the top cover wherein the bottom cover is in a final position.

FIG. 13 is a top view of the assembled housing, bottom cover and top cover of FIG. 1 wherein the top cover is depicted by the cross-sectional view to show the lateral relationship among the latches of the top cover and of the bottom cover within the cavity of the housing.

DETAILED DESCRIPTION OF THE PREFERRED EMBODIMENT

Figure 1:
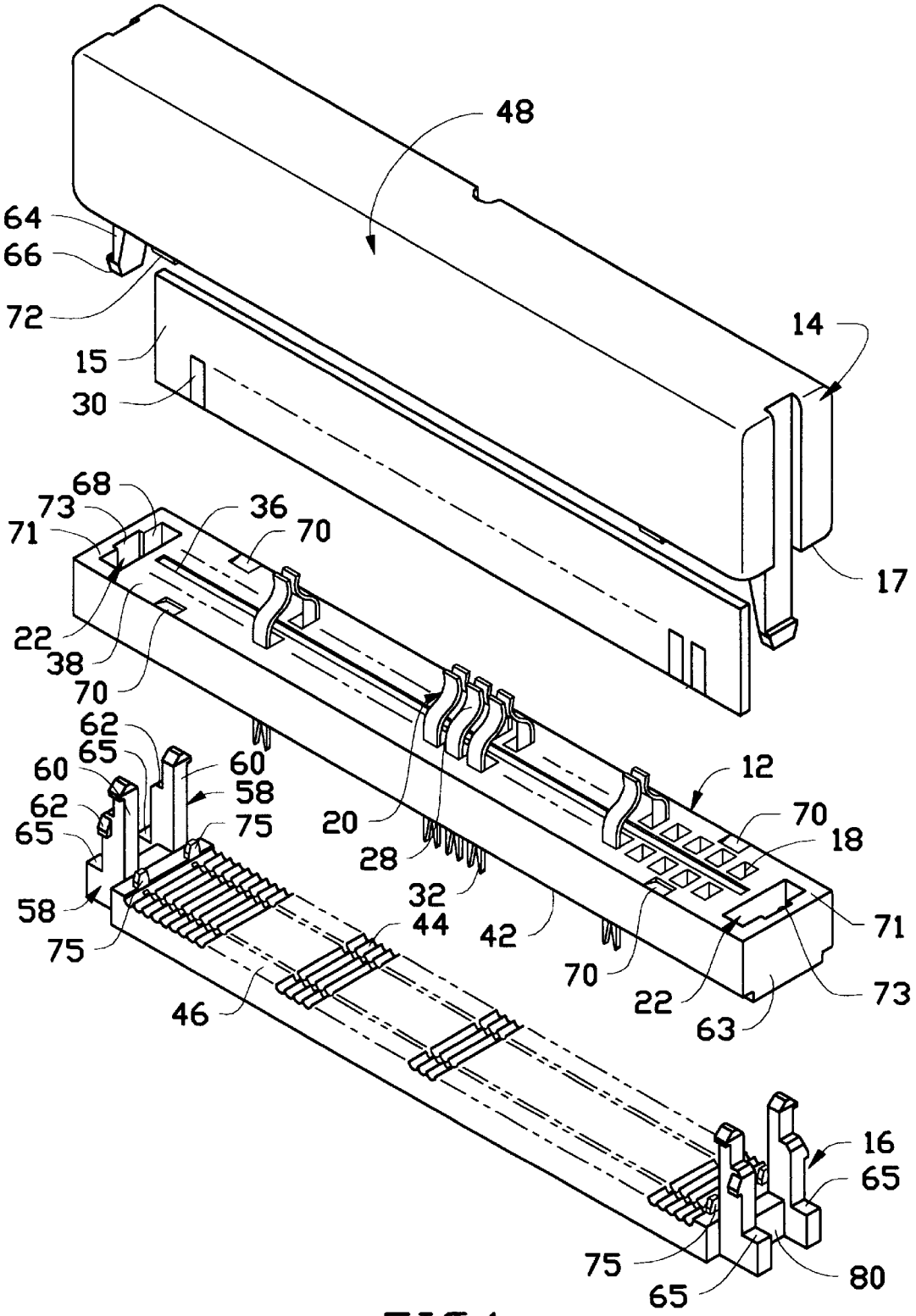
FIG. 1 is an exploded perspective view of a presently preferred embodiment of an IDC type terminator according to the invention.

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–4 wherein a terminator 10 includes an insulative housing 12 generally sandwiched between a top cover 14 and a bottom cover 16. A PC board 15 vertically stands on the housing 12 and enclosed within the top cover 14. The housing 12 comprises two rows passageways 18 along its lengthwise direction for receiving a plurality of corresponding contacts 20 therein, and a pair of cavities 22 positioned at two opposite ends thereof.

Figure 1A:
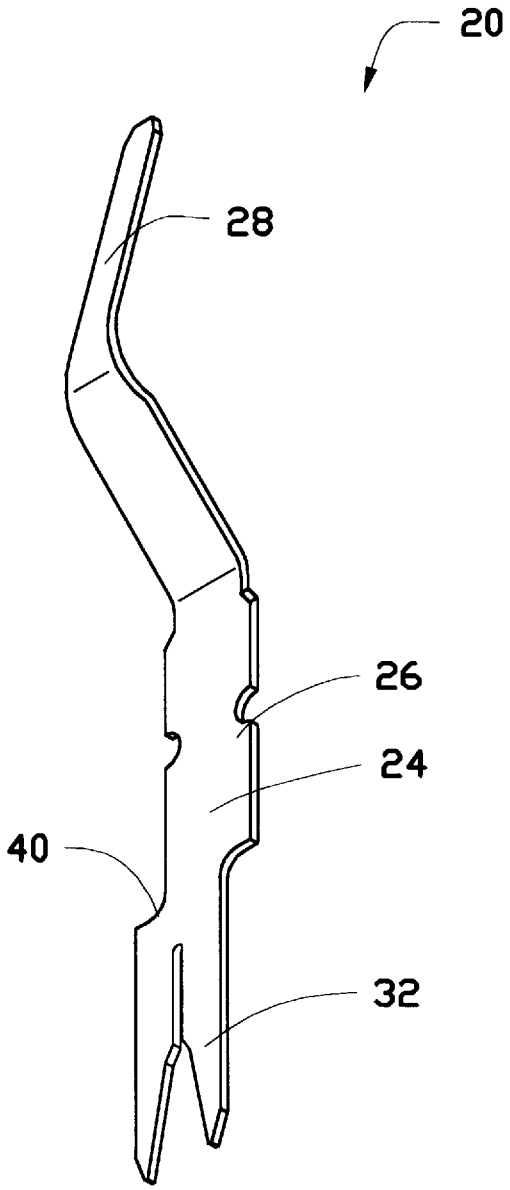
FIG. 1(A) is a perspective view of the contact of FIG. 1.
Figure 3:
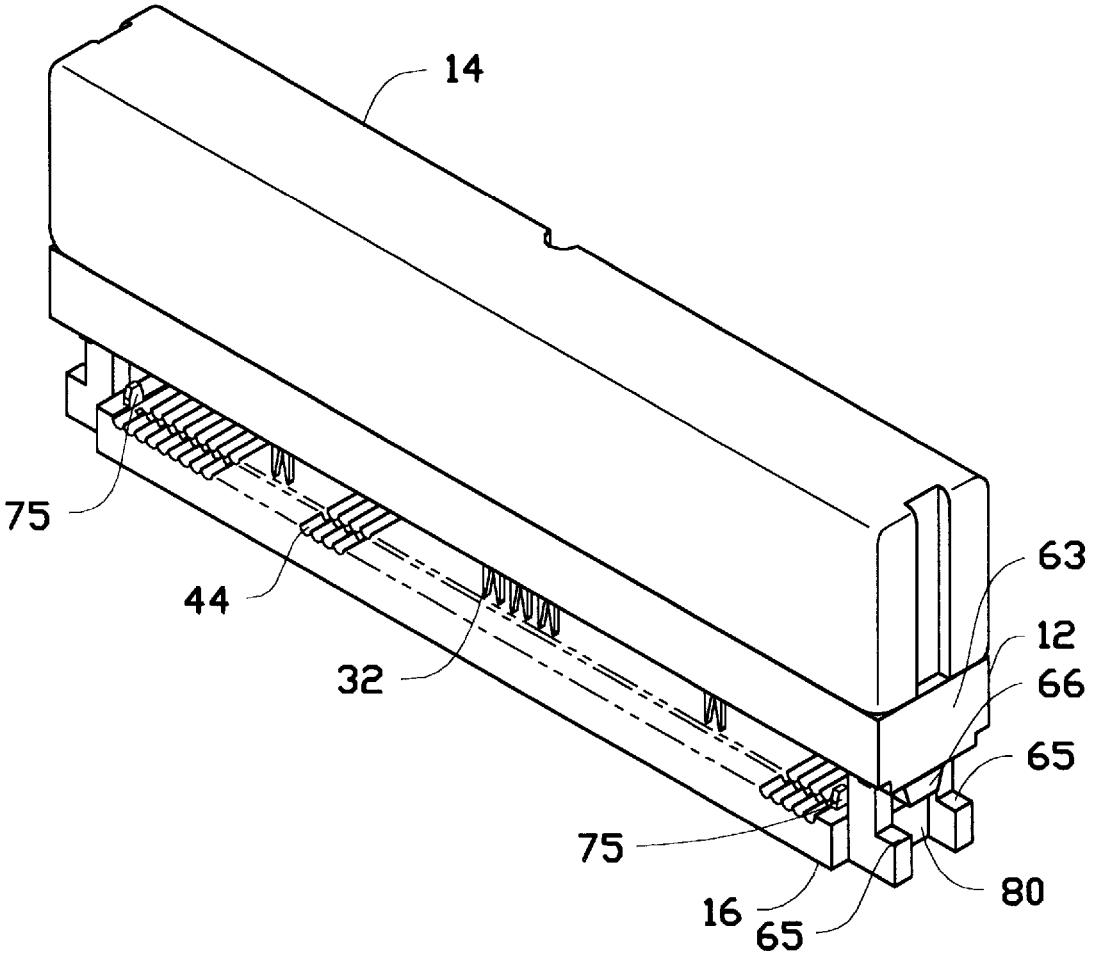
FIG. 3 is a perspective view of the assembled housing, top cover and bottom cover of FIG. 2 wherein the bottom cover is in a preliminary position with regard to the housing and without any flat cable sandwiched therebetween.
Figure 4:
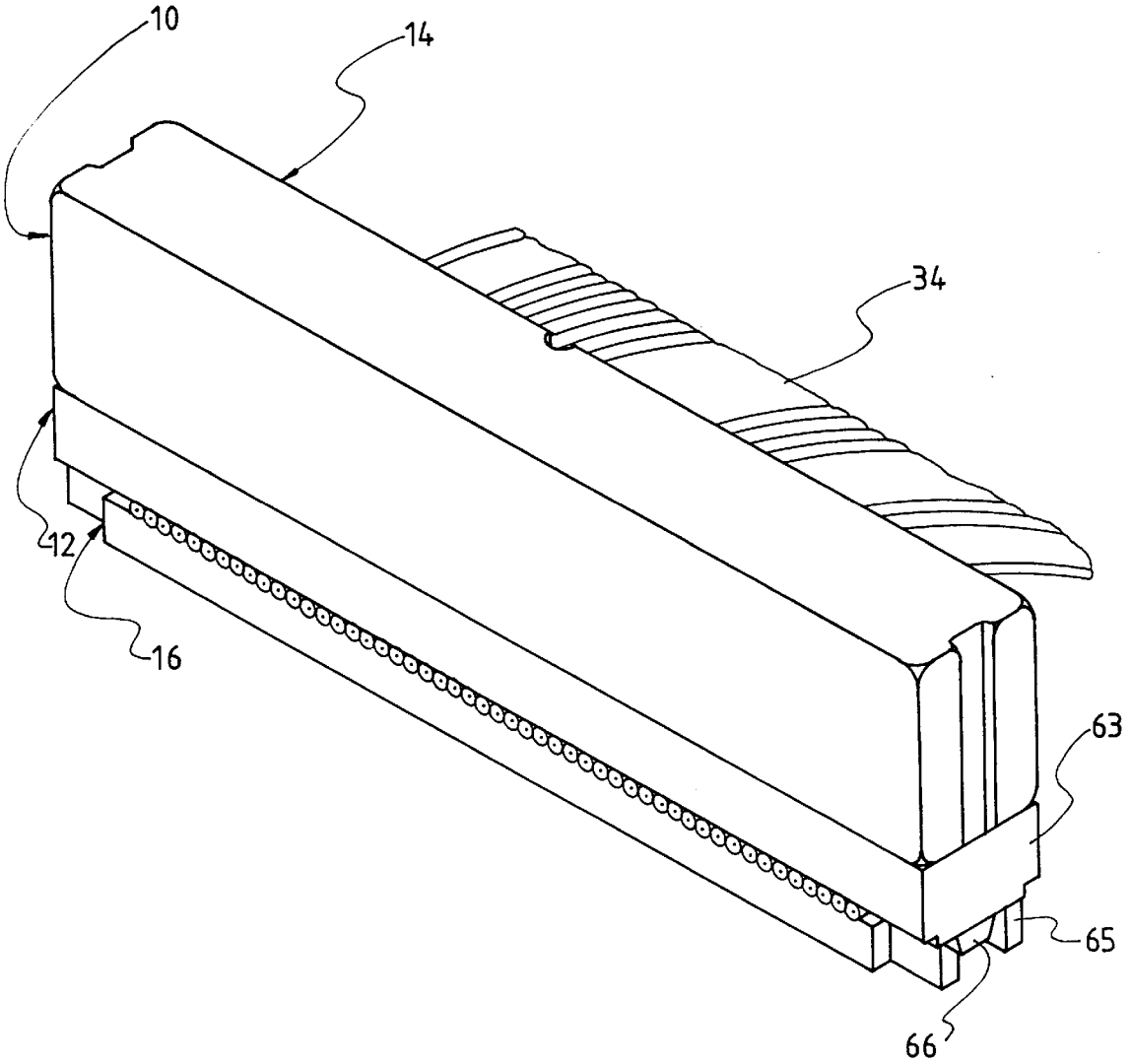
FIG. 4 is a perspective view of the assembled housing, top cover and bottom cover of FIG. 3 wherein the bottom cover is in a final position with regard to the housing and with the flat cable sandwiched therebetween.

Also referring to FIG. 1(A), each contact 20 includes a main body 24 having barbs 26 on two sides for retainable reception within the corresponding passageway 18. A solderable contacting section 28 extends upward from the main body 24 for soldering onto the corresponding pad 30 on the PC board 15, and a fork-like terminating section 32 extends downward from the main body 24 for piercing into the corresponding flat cable 34 (FIG. 4) which is designated to be sandwiched between the housing 12 and the bottom cover 16 in a later time. To align the PC board 15 on the housing 12, a shallow slot 36 is formed on the top surface 38 of the housing 12, and thus the PC board 15 can be easily and actually arranged standing on the central line portion of the housing 12 wherein the contact sections 28 of the two-row contacts 20 are substantially engaged with the corresponding pads 30 on two sides of the PC board 15.

The terminating section 32 is generally offset with regard to the main body 24 in the lengthwise direction of the whole contact 20, and forms a step 40 thereof to be cooperatively received within a recess (not shown) formed on the bottom surface 42 of the housing 12. Accordingly, after the flat cable 34 is attached to the terminator 10 and sandwiched between the housing 12 and the bottom cover 16, the terminating section 32 of each contact 20 is restrained between the housing 12 and the bottom cover 16.

A plurality of flutes 44 are formed on the top surface 46 of the bottom cover 16 for correspondingly receiving the flat cable 34 therein. Oppositely, the top cover 14 has an interior cavity 48 for receiving the PC board 15 therein. The feature of the invention is focused on the structural relationship among the housing 12, the top cover 14 and the bottom cover 16 for retention and assembling purposes.

Figure 5:
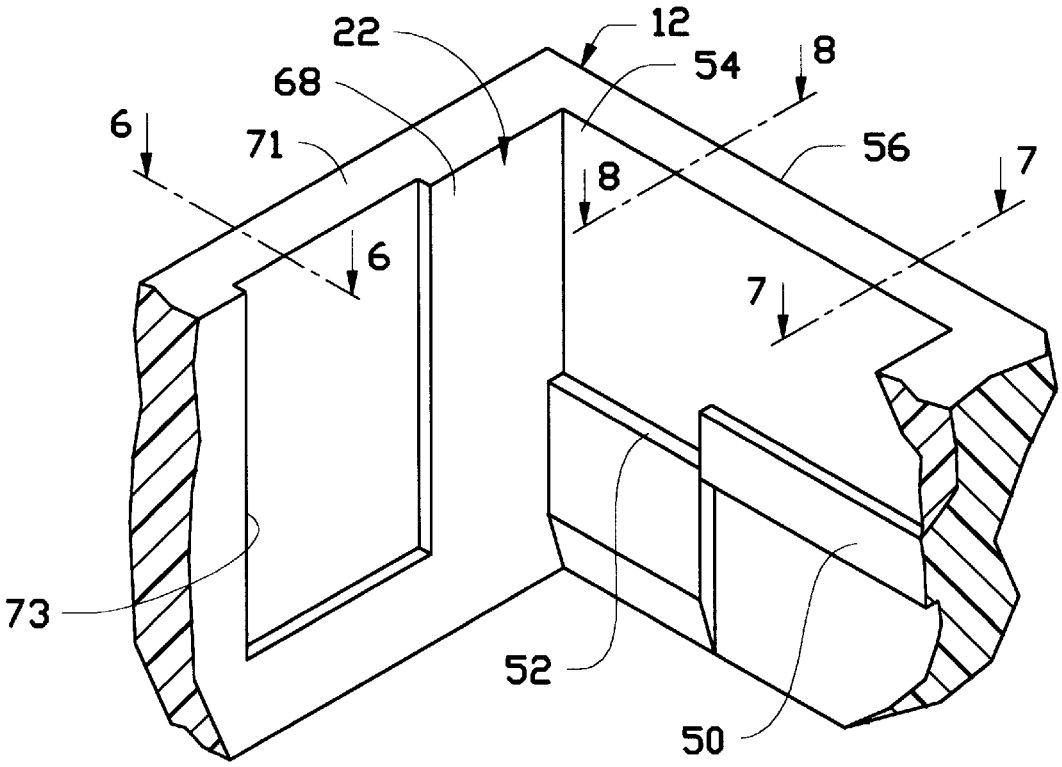
FIG. 5 is a fragmentary perspective view of the housing of FIG. 1 to show the interior structure of the cavity therein.

Further referring to FIG. 5, each cavity 22 positioned at either opposite end of the housing 12 includes two side-by-side shoulders 50, 52 formed on the interior surface 54 of each side wall 56 around the cavity 22. Correspondingly, the bottom cover 16 includes a pair of latches 58 extending upward at either end thereof wherein each latch 58 includes a first protrusion 60 projecting outward on the top portion and a second protrusion 62 projecting outward on the middle portion. Through the cooperation between the shoulders 50, 52 of the housing 12 and the first and second protrusions 60, 62, the bottom cover 16 can be fastened to the housing 12. The details will be illustrated later. To provide more stability of the engagement between the housing 12 and the bottom cover 16, the housing 12 is provided with a pair of standoffs 63 (only one shown in FIG. 1) respectively downward extending from two opposite ends thereof and sitting on the two corresponding seats 65 laterally formed on two opposite ends of the bottom cover 16.

Oppositely, the top cover 14 also includes a pair of hooks 64 downward extending from the bottom surface 17 (FIG. 1) at two ends wherein each hook 64 has a protrusion 66 at the tip. Similar to the bottom cover 16, the top cover 14 and the housing 12 can be fastened together via the engagement between the hooks 64 of the top cover 14 and the standoffs 63 of the housing 12 which also will be described in detail later.

Figure 6:
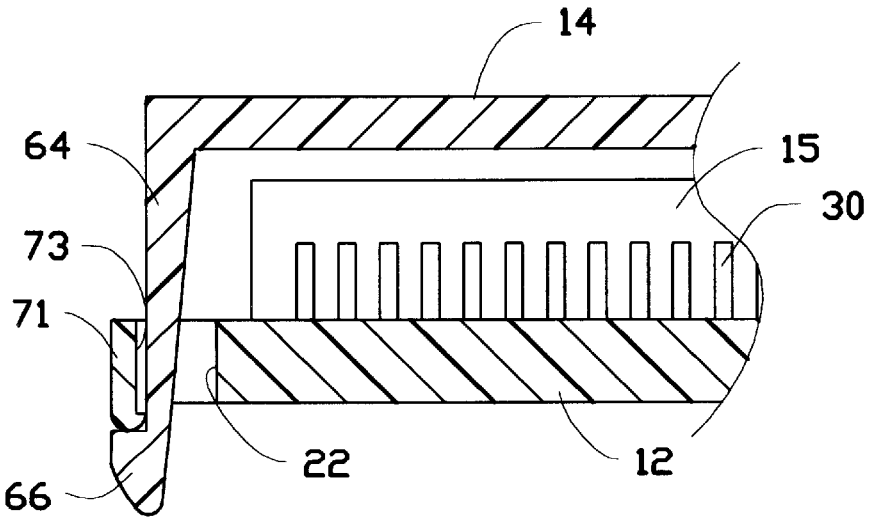
FIG. 6 is a partial cross-sectional view, along line 6—6, of the assembled housing and top cover of FIG. 1 without contacts therein to show how the top cover encloses the PC board therein and how the latch of the top cover engages the housing for fastening.

The assembling of the whole terminator 10 is easy and reliable. Referring to FIGS. 6, 9 and 10, first, the top cover 14 is attached to the housing 12, which already has the PC board 15 installed thereon and the contacts 20 installed therein, until the bottom surface 17 of the top cover 14 abuts against the top surface 38 of the housing 12. Under this condition, the hooks 64 of the top cover 14 initially inwardly deflected to have the protrusion 66 pass along the end interior surface 68 of the housing 12 around the cavity 22, and finally spring outwardly to resume back to its vertical position and engaged against the bottom surface of the standoff 63. It is noted that to vertically align the top cover 14 with the housing 12, there are four recesses 70 on the top surface 38 of the housing 12 for engagement with four corresponding dimples 72 (only two shown in FIG. 1) formed on the bottom surface 17 of the top cover 14, respectively, and thus the top cover 14 can not be moveable with regard to the housing 12 laterally after the top cover 14 has been locked to the housing 12 by means of the hooks 64.

Successively, referring to FIGS. 7–10 wherein FIGS. 7, 7(A) and 8 intentionally do not show the top cover for easy viewing and understanding the mutual structural relationship between the bottom cover and the housing, while the complete assembly should be referred to FIGS. 9 and 10, the bottom cover 16 is attached to the housing 12 from the bottom wherein the latches 58 of the bottom cover 16 are respectively inserted into the corresponding cavities 22, respectively. Under this situation, the latches 58 are deflected inward by confrontation with the interior surfaces 54 of the side walls 56 of the housing 12. The upward movement of the bottom cover 16 with regard to the housing 12 continues until the first protrusions 60 pass over and substantially engaged with the corresponding first shoulders 50. Thus, the bottom cover 16 is precisely positioned in the first initial position with regard to the housing 12. Under this condition, referring to FIG. 7 (A), the front engagement surfaces 76 of the second protrusions 62 of the latches 58 are properly butt the leading surfaces 78 on the interior surface 54 of the housing 12, and therefore, through the engagements between the first protrusions 60 of the latches 58 of the bottom cover 16 and the first shoulder 50 in the cavities 22 in the housing 12, and between the engagement surfaces 76 of the second protrusions 62 of the latches 58 of the bottom cover 16 and the leading surfaces 78 in the cavities 22 in the housing 12, the bottom cover 16 is suspended in the first initial position with regard to the housing 12. Thus, a space remains between the top surface 46 of the bottom cover 16 and the bottom surface 42 of the housing 12 for receiving the flat cable 34 therein, as shown in FIGS. 7, 7(A), 9 and 11.

Finally, the bottom cover 16 is pressed and moved toward the housing 12 until the bottom cover 16 is tightly fastened to the housing 12 in its second final position wherein the bottom surface 42 of the housing 12 substantially butt the top surface 46 of the bottom cover 16 and the flat cable 34 has been pierced by the corresponding plural terminating sections 32 of the contacts 20 for conduction. During this procedure, the latches 58 of the bottom cover 16 is initially inwardly deflected to have the second protrusions 62 thereof pass along the interior surfaces 54 until such second protrusions 62 of the latches 58 of the bottom cover 16 pass over the corresponding second shoulders 52 in the cavities 22 in the housing 12. Then the latches 58 can be sprung outwardly and the second protrusions 62 are substantially engaged with the second shoulder 52. Thus, through the engagements between the standoffs 63 of the housing 12 and the seats 65 of the bottom cover 16, and between the second protrusions 62 of the latches 58 of the bottom cover 16 and the second shoulders 52 of the housing 12, the bottom cover 16 is securely fastened to the housing 12 in the vertical direction.

Therefore, the housing 12, the top cover 14 and the bottom cover 16 are mutually fastened together to form a one piece assembly, as shown in FIGS. 8, 10 and 12.

One feature of the invention is to provide mechanism that the whole assembly of the terminator 10 can not be disassembled once these three parts, i.e., the housing 12, the top cover 14 and the bottom cover 16, have been fastened together to form as one piece. Therefore, it is impossible to unintentionally pull or deflect any exposed portions of the whole assembly to disassemble it.

In a detailed analysis, the latches 58 of the bottom cover 16 are completely and fully embedded within the cavities 22 of the housing 12 wherein the first protrusions 60 further project into the interior of the top cover 14, so by no means are the latches 58 of the bottom cover 16 deflected inward to be disengaged from the housing 12. Oppositely, referring to FIGS. 1, and 11–13, the hooks 64 of the top cover 14 also project through the cavities 22 and substantially disposed between the corresponding pair of latches 58 without interference, while such hooks 64 confront the end walls 80, in the lengthwise direction, formed on the bottom cover 16 and substantially restrained from moving inwardly by such end walls 80. Thus, it is impossible to deflect the protrusions 66 of the hooks 54 inwardly for disengaging the hooks 64 from the housing 12, and this assuring the permanent securement between the top cover 14 and the housing 12. Therefore, the housing 12 and its associated top cover 14 and bottom cover 16 can no more be separated with each other.

In this embodiment, the middle part, i.e., the housing 12, sandwiched between two outer parts, i.e., the top cover 14 and the bottom cover 16, functions as a basis to have the other two outer parts attached thereunto from opposite sides wherein the top cover 14 abuts against the top surface 38 of the housing 12 with the protrusions 66 of its hooks 64 extending out of the bottom surface 42 of the housing 12, while the bottom cover 16 abuts against the bottom surface 42 of the housing 12 with the protrusions 60 extending out of the top surface 38 of the housing 12. To save space in the same cavity 22, the hook 64 of the top cover 14 is sandwiched between the corresponding pair of latches 58 of the bottom cover 16 whereby the locking engagement for the protrusions 60 and 62 of the outer latches 58 with the housing 12 is implemented in the lateral direction on the side wall 56 of the housing 12, while the locking engagement for the protrusions 66 of the middle hook 64 with the housing 12 is implemented in the lengthwise direction on the end wall 71. These two directions are orthogonal with each other.

Moreover, in this embodiment, to ease insertion of the hook 64 into the cavity 22, the interior surface 68 of the end wall 71 of the housing 12 includes a shallow channel 73. Also, to align the inserted flat cable 34 with regard to the bottom cover 16, four posts 75 upward extend from the top surface 46 of the bottom cover 16 so that the flat cable 34 can be aligned with the terminating sections 32 of the contacts 20. Correspondingly, four recesses (not shown) are formed in the housing 12 for receiving such four upward extending posts 75 of the bottom cover 16 when the bottom cover 16 and the housing 12 fastened together.

It is also noted that in this embodiment the top cover 14 should be fully fastened to the housing 12 before the bottom cover 16 is fully fastened thereto. The reason is that the end walls 80 of the bottom cover 16 will prohibit the hooks 64 of the top cover 14 from moving inward in the lengthwise direction once the bottom cover 16 is in its final position with regard to the housing 12, regardless of whether the top cover 14 is intended to be inserted into or withdrawn from the housing 12.

While the present invention has been described with reference to specific embodiments, the description is illustrative of the invent and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A terminator for use with a flat cable, comprising:

an elongated insulative housing defining a top surface and a bottom surface with a plurality of passageways extending therethrough for receiving a plurality of corresponding contacts therein, two lengthwise ends and two lateral sides substantially orthogonal to the lengthwise ends;

an elongated top cover attached onto the top surface of the housing for enclosing a PC board therein;

an elongated bottom cover attached to the bottom surface of the housing for sandwiching said flat cable therebetween;

each of said contacts including a main body, a solderable contact section extending upward therefrom to mount to the PC board, and a terminating section extending downward therefrom to pierce into the flat cable;

a cavity formed at one of the lengthwise ends of the housing for allowing a pair of latches of the bottom cover and a hook of the top cover to commonly extend therethrough, wherein after the bottom cover and the top cover are securely fastened to the housing, respectively, the latches of the bottom cover and the hook of the top cover are respectively latched to the housing, and the latches are entirely received in the housing and the top cover, and the hook is locked in position by a restraining means effectively preventing the hook from separating from its engagement with the housing, whereby the top cover and the bottom cover are securely connected to the housing, said restraining means being a lengthwise end of the bottom cover confronting the hook, each latch engaging a corresponding lateral side of the housing, the hook being located between the latches, and the lengthwise end of the bottom cover being located between the hook and the housing to restrain said hook from moving toward a middle portion of the housing.

2. The terminator as described in claim 1, wherein each latch includes an upper protrusion and a lower protrusion, and each lateral side of the housing includes a first and a second shoulders for engagement with said upper and lower protrusions.

3. The terminator as described in claim 1, wherein each latch has a protrusion projecting toward one of the lateral sides of the housing and the hook has a protrusion projecting toward one of the lengthwise ends of the housing.

4. The terminator as described in claim 1, wherein said bottom cover includes post means for aligning the flat cable with the corresponding terminating sections of the contacts.

5. The terminator as described in claim 1, wherein means are provided on the top cover and the housing for aligning the top cover with the housing.

* * * * *